US007861641B2

(12) United States Patent
Weddfelt

(10) Patent No.: US 7,861,641 B2
(45) Date of Patent: Jan. 4, 2011

(54) IMPULSE GENERATOR AND METHOD FOR IMPULSE GENERATION

(75) Inventor: Kenneth Weddfelt, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 376 days.

(21) Appl. No.: 11/886,509

(22) PCT Filed: May 19, 2006

(86) PCT No.: PCT/SE2006/000583

§ 371 (c)(1),
(2), (4) Date: Sep. 17, 2007

(87) PCT Pub. No.: WO2006/126935

PCT Pub. Date: Nov. 30, 2006

(65) Prior Publication Data

US 2008/0105115 A1 May 8, 2008

(30) Foreign Application Priority Data

May 23, 2005 (SE) ..... 0501153

(51) Int. Cl.
*F01B 7/18* (2006.01)
*F15B 15/17* (2006.01)

(52) U.S. Cl. ..... 91/321; 91/417 A

(58) Field of Classification Search ..... 91/321, 91/417 R, 417 A

See application file for complete search history.

(56) References Cited

U.S. PATENT DOCUMENTS 3,605,555 A 9/1971 Wise 4,022,108 A * 5/1977 Juvonen ..... 91/321

(Continued)

FOREIGN PATENT DOCUMENTS

GB 1142172 2/1969

(Continued)

*Primary Examiner*—F. Daniel Lopez
(74) *Attorney, Agent, or Firm*—Mark P. Stone

(57) ABSTRACT

The invention relates to an impulse generator for a rock breaking tool, the impulse generator (2) comprising a main chamber (4) for receiving a first pressurizeable fluid volume (6), an in the main chamber (4) received impulse piston (8) which is arranged for transfer of pressure energy in the fluid volume (6) into impulses in the tool (10), and a on the side opposite the main chamber (4) side of the impulse piston (8) situated prepressurizing chamber (12) for receiving a second pressurizeable fluid volume (14), where the impulse generator (2) further comprises a on the side opposite the main chamber (4) side of the impulse piston (8) situated pressure relief chamber (16) for receiving a third pressurizeable fluid volume (18), where the relationship between the pressurizing pressures in the fluid volumes (6,14,18) and the relations between the areas of the impulse piston (8) facing the chambers (4,12,16) are such that pressurizing of at least the prepressurizing chamber (12) displaces the impulse piston (8) in the direction towards the main chamber (4) and the pressure in the main chamber (4) effects a pressure increase in the pressure relief chamber (16) when the prepressurizing chamber (12) is depressurized, whereby the depressurizing rate in the pressure relief chamber (16) and the velocity of the then transferred pressure impulse into the tool (10) are increased (12). The invention also relates to a hydraulic tool comprising an impulse generator (2), and a method for generation of impulses in a rock breaking tool.

21 Claims, 3 Drawing Sheets

U.S. PATENT DOCUMENTS

| | | | |
|---|---|---|---|
| 4,159,039 | A | 6/1979 | Kasuga et al. |
| 5,222,425 | A | 6/1993 | Davies |
| 5,549,252 | A | 8/1996 | Walter |
| 6,112,832 | A | 9/2000 | Muuttonen et al. |
| 2004/0226752 | A1 | 11/2004 | Keskiniva et al. |

FOREIGN PATENT DOCUMENTS

| | | |
|---|---|---|
| GB | 329921 | 5/1980 |
| GB | 2047794 | 12/1980 |
| WO | 96/19323 | 6/1996 |
| WO | 03/004822 | 1/2003 |
| WO | 03/033873 | 4/2003 |
| WO | 03/095153 | 11/2003 |
| WO | 2004/073930 | 9/2004 |
| WO | 2004/073931 | 9/2004 |
| WO | 2004/073932 | 9/2004 |
| WO | 2004/073933 | 9/2004 |
| WO | 2005/002801 | 1/2005 |
| WO | 2005/002802 | 1/2005 |
| WO | 2005080051 | 9/2005 |

* cited by examiner

IMPULSE GENERATOR AND METHOD FOR IMPULSE GENERATION

TECHNICAL FIELD

The present invention relates to an impulse generator for a rock breaking tool, and a method for generation of impulses with impulse generator.

BACKGROUND

In traditional rock breaking tools a piston which pneumatically or hydraulically is made to move back and forth in a cylinder is used, where the piston strikes directly or indirectly via for example a drill steel shank against the end of a drilling steel which in turn strikes the rock. By that the piston, which has a relatively large mass, moves quickly towards the drilling steel unwanted dynamic acceleration forces arise in the drilling rig which strive to pull the drilling steel away from the rock.

In order to decrease the above mentioned dynamic acceleration forces efforts have been made with rock breaking tools which contrary to the traditional rock breaking tools have a piston that does not move as far back and forth in the cylinder during transfer of the impact force which also brings about a possibility to increase the impact frequency.

GB 2 047 794 A shows a rock breaking tool where a piston is pretensioned by pressurizing a pressure fluid space on the tool side of the piston, so that the piston is moved in the direction away from the drill steel at the same time as a pressure is built up in an energy storing space on the side of the piston opposite to the drill steel side. By that then depressurizing the pressure fluid space, the piston is released whereby the pressure in the energy storing space forces the piston towards the drill steel whereby a stress pulse strikes the drill steel.

WO 03/095153 A1 shows another rock breaking tool where a piston is pretensioned by pressurizing a pressure fluid space on the tool side of the piston, so that the piston is moved in the direction away from the drill steel at the same time as a pressure is built up in an energy storing space on the side of the piston opposite to the drill steel side. By that then depressurizing the pressure fluid space, the piston is released whereby the pressure in the energy storing space forces the piston towards the drill steel whereby a stress pulse strikes the drill steel.

BRIEF DESCRIPTION OF THE INVENTION

The problem with the occurrence of large dynamic acceleration forces is solved according to the invention by arranging an impulse generator for a rock breaking tool, the impulse generator comprising a main chamber for receiving a first pressurizeable fluid volume, an in the main chamber received impulse piston which is arranged for transfer of pressure energy in the fluid volume into impulses in the tool, and a on the side opposite the main chamber side of the impulse piston situated prepressurizing chamber for receiving a second pressurizeable fluid volume, where the impulse generator further comprises a on the side opposite the main chamber side of the impulse piston situated pressure relief chamber for receiving a third pressurizeable fluid volume where the relation between the pressurizing pressures in the fluid volumes and the relations between the areas of the impulse piston facing the chambers are such that pressurizing of at least the prepressurizing chamber displaces the impulse piston in the direction towards the main chamber and that the pressure in the main chamber effects a pressure increase in the pressure relief chamber when the prepressurizing chamber is depressurized, whereby the depressurizing rate in the pressure relief chamber and the velocity of the then transferred pressure impulse into the tool are increased.

By that the impulse generator comprises the characteristics in claim 1, is attained the advantage of bringing about an impulse generator where the pressure that is attained in the pressure relief chamber is higher than the pressure that has originally been fed therein, whereby faster draining of the pressure relief chamber is attained.

BRIEF DESCRIPTION OF DRAWINGS

The invention will be described below in greater detail with reference to the attached drawings, in which.

DESCRIPTION OF PREFERRED EMBODIMENTS

Figure 1:
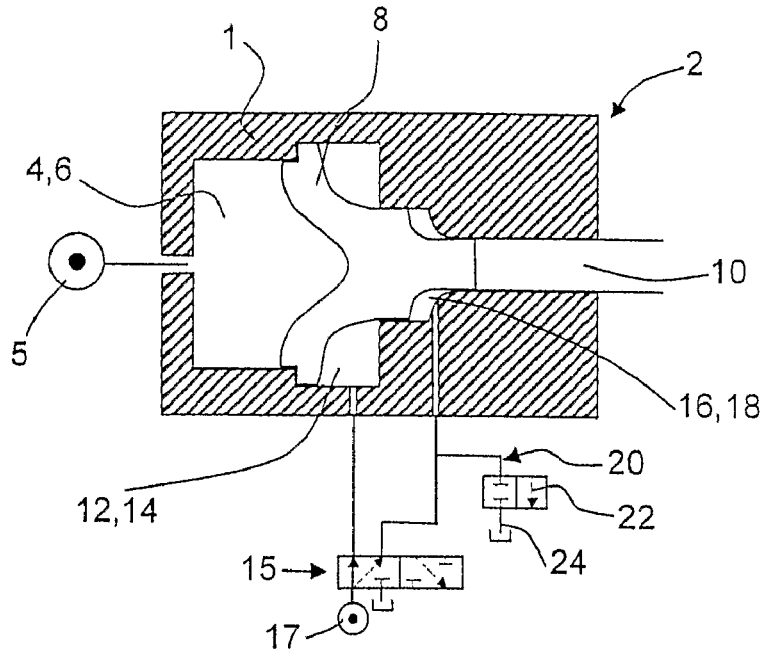
FIG. 1 shows schematically a longitudinal section of an embodiment of an impulse generator with pressurized prepressurizing chamber.

FIG. 1 shows schematically a longitudinal section of an embodiment of an impulse generator 2 with pressurized prepressurizing chamber 12, the impulse generator 2 comprising a housing 1 with a main chamber 4 for receiving a first pressurizeable fluid volume 6, a in the main chamber 4 received impulse piston 8, which is arranged for transfer of pressure energy in the fluid volume 6 into impulses in a tool 10, and a on the side opposite the main chamber 4 side of the impulse piston 8 situated prepressurizing chamber 12 for receiving a second pressurizeable fluid volume 14, where the impulse generator 2 further comprises a on the side opposite the main chamber 4 side of the impulse piston 8 situated pressure relief chamber 16 for receiving a third pressurizeable fluid volume 18. The main chamber 4 is preferably under a constant pressure which pressure is produced by that e.g. arranging a pressure source 5, e.g. a pump, which is controlled so that a constant pressure is maintained.

Pressurizing of the prepressurizing chamber 12 and the pressure relief chamber 16 takes place e.g. via a filling valve 15 which preferably is connected to a pressure source 17 which pressure source 17 preferably is connected to the pressure source 5 via a channel. The pressure source 17 may optionally be the same pressure source as the pressure source 5.

The pressure in the pressure relief chamber 16 increases when the prepressurizing chamber 12 is depressurized according to what is described in more detail below, whereafter a pressure impulse is transferred into the tool 10 when the pressure relief chamber 16 is depressurized in turn. The relation between the pressurizing pressures in the fluid volumes 6,14,18 and the relations between the area of the impulse piston 8 facing the chambers 4,12,16 are such that pressurizing of at least the prepressurizing chamber 12 displaces the impulse piston 8 in the direction towards the main chamber 4 and the pressurizing pressure in the main chamber 4 effects a pressure increase in the pressure relief chamber 16 when the prepressurizing chamber 12 is depressurized, whereby the depressurizing rate in the pressure relief chamber 16 and the velocity of the then transferred pressure impulse into the tool 10 are increased. The volume of the pressure relief chamber 16 is preferably smaller than the volume of the prepressurizing chamber 12. The area of the impulse piston 8 towards the main chamber 4 is larger than the area of the impulse piston 8 towards the pressure relief chamber 16 so that the pressure in the pressure relief chamber 16 is higher than the pressure in the main chamber 4 at a state of equilibrium. Thus is attained, through the relationship between the areas of the impulse piston towards the main chamber and the pressure relief chamber 16, respectively, an advantageous effect consisting of that the lower pressure in the main chamber is transformed to a higher pressure in the pressure relief chamber. This results in that the pressure relief chamber may be drained faster than would have been the case if the pressure in the pressure relief chamber would have been the same as in the main chamber. The process of depressurization of the pressure relief chamber 16 may preferably be controlled with a control device 20, where the control device 20 preferably is a to the pressure relief chamber 16 connected control valve. The control valve 20 preferably comprises at least one opening 22 for controlling of the said depressurization by draining of in the pressure relief chamber 16 during operation contained pressure medium 18. The main chamber 4, the prepressurizing chamber 12 and the pressure relief chamber 16 are preferably adapted to that in the fluid volume shall be received a fluid preferably from the group: water, silicone oil, hydraulic oil, mineral oil, and non-combustible hydraulic fluid. The main chamber 4 has preferably a circular cross-section.

Figure 2:
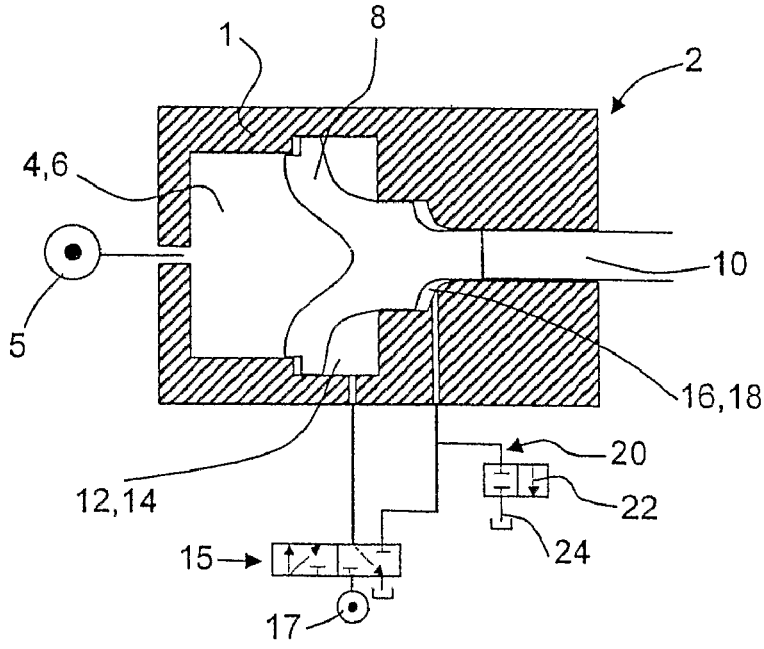
FIG. 2 shows schematically a longitudinal section of an impulse generator according to FIG. 1 with depressurized prepressurizing chamber.
Figure 3:
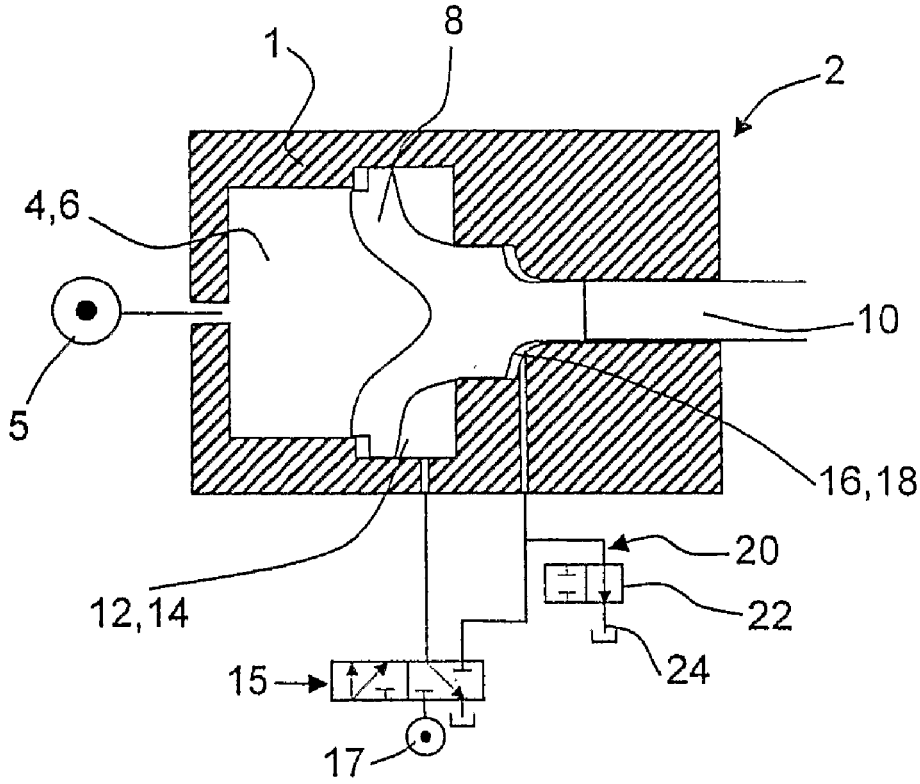
FIG. 3 shows schematically a longitudinal section of an impulse generator according to FIG. 1 with depressurized prepressurizing chamber.

FIG. 2 shows schematically a longitudinal section of an impulse generator according to FIG. 1 with depressurized prepressurizing chamber 12, and FIG. 3 shows schematically a longitudinal section of an impulse generator according to FIG. 1 with depressurized pressure relief chamber 16.

An embodiment of a method for generation of impulses in a rock breaking tool with an impulse generator 2 comprising a main chamber 4 for receiving a first pressurizeable fluid volume 6, a in the main chamber 4 received impulse piston 8, which is arranged for transfer of pressure energy in the fluid volume 6 into impulses in the tool 10, and further a on the side opposite the main chamber 4 side of the impulse piston 8 situated prepressurizing chamber 12 for receiving a second pressurizeable fluid volume 14, and a on the side opposite the main chamber 4 side of the impulse piston 8 situated pressure relief chamber 16 for receiving a third pressurizeable fluid volume 18, where the main chamber 4 preferably is pressurized with an essentially constant pressure as described above, comprises the following steps:

pressurizing the prepressurizing chamber 12 which results in that the impulse piston 8 moves in the direction towards the main chamber 4 according to what can be seen in FIG. 1, pressurizing the pressure relief chamber 16, preferably with the same pressure which exists in the main chamber 4, whereby the impulse piston 8 still is situated at the position described in FIG. 1, and thereafter depressurizing the prepressurizing chamber 12 whereby the pressure in the main chamber 4 effects the impulse piston 8 so that the pressure in the pressure relief chamber 16 is further increased by that the impulse piston 8 moves in the direction towards the pressure relief chamber 16 until equilibrium of forces is established between the main chamber 4 and the pressure relief chamber 16 according to what is shown in FIG. 2, whereafter the pressure relief chamber 16 is depressurized whereby a pressure impulse is transferred into the tool 10 according to what is shown in FIG. 3.

A further embodiment of a method for generation of impulses in a rock breaking tool of the type mentioned above where the area of the impulse piston 8 towards the main chamber 4 is smaller than the sum of the area of the impulse piston 8 towards the prepressurizing chamber 12 and the pressure relief chamber 16 but larger than the area of the impulse piston 8 towards the pressure relief chamber 16, comprises the following steps:

pressurizing the main chamber 4, the prepressurizing chamber 12, and the pressure relief chamber 16 with the same pressure, i.e. the pressure provided by the pressure source 5, which results in that the impulse piston 8 moves in the direction towards the main chamber 4 according to what can be seen in FIG. 1, thereafter depressurizing the prepressurizing chamber 12 whereby the pressure in the main chamber 4 effects the impulse piston 8 so that the pressure in the pressure relief chamber 16 is further increased by that the impulse piston 8 moves in the direction towards the pressure relief chamber 16 until equilibrium of forces is established between the main chamber 4 and the pressure relief chamber 16 according to what is shown in FIG. 2, whereafter the pressure relief chamber 16 is depressurized whereby a pressure impulse is transferred into the tool 10 as shown in FIG. 3.

Figure 4:
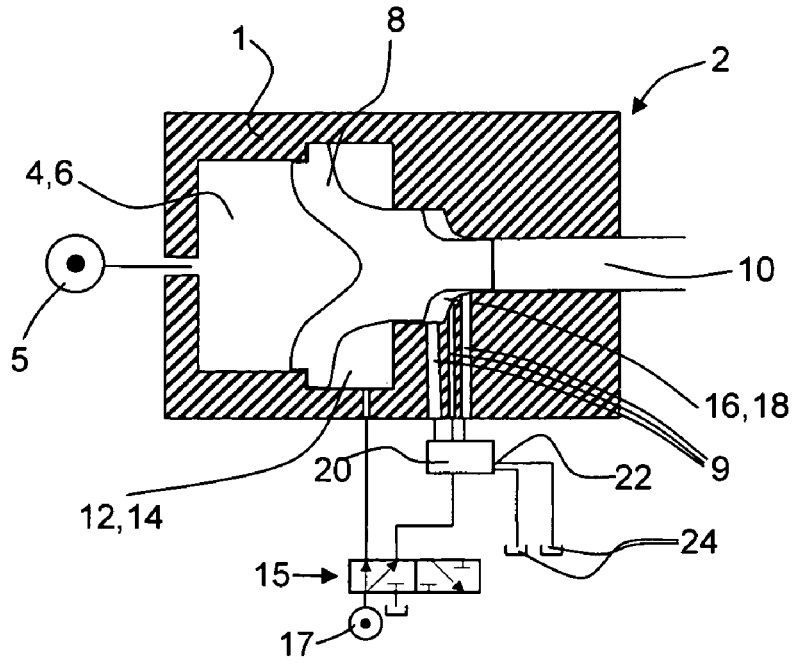
FIG. 4 is similar to FIG. 1 and illustrates another embodiment of the invention.
Figure 5:
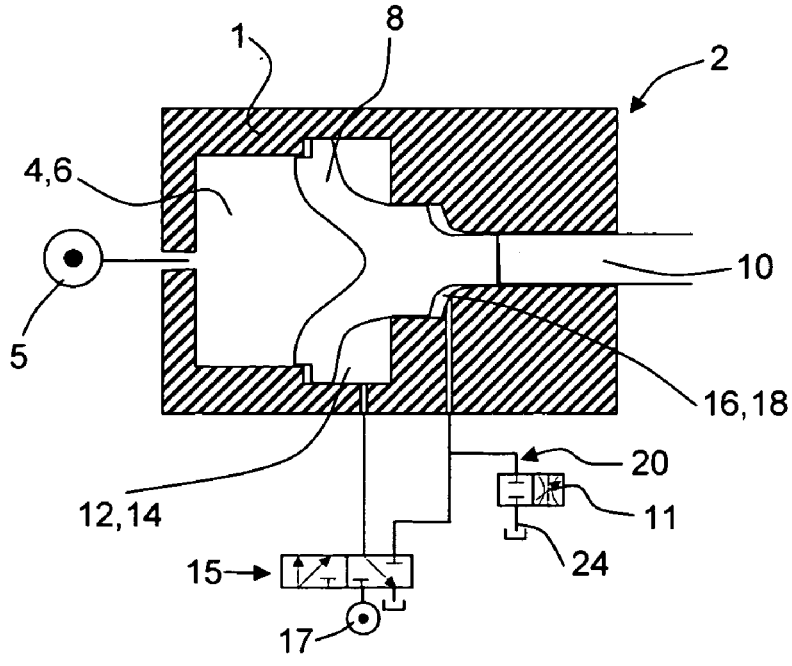
FIG. 5 is similar to FIG. 2 and illustrates a further embodiment of the invention.

The depressurizing process in said pressure relief chamber 16 may further preferably be controlled by a control device 20, where the control device preferably is a to the pressure relief chamber 16 connected control valve 20. Said control device may also comprise means for controlling said depressurization by control of a for connection to the pressure relief chamber 16 designed throttle valve 11 (FIG. 5). The control valve may comprise at least one opening 22 for control of said depressurization by discharge of in the pressure relief chamber 16 during operation contained pressure medium 18. Said control device may comprise means for controlling said depressurization by controlling of the opening process of the control valve 20, where said means preferably comprise control of the opening area of the control valve. The control valve 20 may be designed with depressurization grooves for controlling of said depressurization and also comprise several openings 22 (FIG. 4). The said pressure relief chamber 16 may comprise several outlets 9 (FIG. 4), whereby said outlets may be opened in a controllable manner, whereby said depressurization may be controlled by opening and closing of the relevant outlets. Said outlets 9 (FIG. 4) may have different diameters. Said outlets 9 (FIG. 4) may be connected with one or several reservoirs 24 (FIG. 4) with one or more flow paths, whereby said reservoirs in operation may be pressurized to different pressures, whereby a step-by-step and/or a continuous depressurization of the pressure relief chamber may be obtained by opening of said outlets. The length of said flow paths may also be adjustable.

The invention relates also to an hydraulic impulse tool comprising an impulse generator as mentioned above. It is possible to combine that which has been mentioned in the different herein described optional embodiments within the scope of the following claims.

The invention claimed is:

1. Impulse generator for a rock breaking tool, the impulse generator (2) comprising a main chamber (4) for receiving a first pressurizeable fluid volume (6), and an impulse piston (8) received in the main chamber (4) and arranged for transfer of pressure energy in the fluid volume (6) into impulses in the tool (10), and a prepressurizing chamber(12) situated on the side of the impulse piston opposite the main chamber for receiving a second pressurizeable fluid volume (14), wherein the impulse generator (2) further comprises a pressure relief chamber (16) situated on the side of the impulse piston opposite the main chamber for receiving a third pressurizeable fluid volume (18), wherein the relationship between the pressurizing pressures in the fluid volume (6, 14, 18) and the relationship between the areas of the impulse piston (8) facing the chambers (4, 12, 16) are such that pressurizing of at least the prepressurizing chamber (12) displaces the impulse piston (8) in the direction towards the main chamber (4), the pressure in the main chamber (4) moving said impulse piston in a direction towards said prepressurizing and pressure relief chambers for increasing the pressure in the pressure relief chamber (16) when the prepressurizing chamber (12) is depressurized, and thereafter transferring a pressure impulse into the tool (10) when the pressure relief chamber (16) is thereafter depressurized.

2. Impulse generator as claimed in claim 1, wherein the main chamber (4) is under an essentially constant pressure.

3. Impulse generator as claimed in claim 2, including a pressure source (5) inside or outside the impulse generator (2) for establishing said essentially constant pressure.

4. Impulse generator as claimed in claim 1, wherein the area of the impulse piston (8) towards the main chamber (4) is larger than the area of the impulse piston (8) towards the pressure relief chamber (16).

5. Impulse generator as claimed in claim 1, wherein a control device (20) controls depressurization of the pressure relief chamber (16).

6. Impulse generator as claimed in claim 5, wherein said control device comprises means for controlling the extent to which the control valve (20) is opened.

7. Impulse generator as claimed in claim 6, wherein the control valve (20) comprises at least one opening (22) for controlling said depressurization by discharge of a pressure medium (18) contained in the pressure relief chamber (16) during operation.

8. Impulse generator as claimed in claim 7, wherein the control valve (20) comprises several openings (22).

9. Impulse generator as claimed in claim 5, wherein said control device comprises means for controlling said depressurization by controlling a throttle valve connectable to the pressure relief chamber.

10. Impulse generator as claimed in claim 1, wherein said pressure relief chamber (16) comprises several outlets, said outlets being arranged to be opened in a controllable manner, said depressurization being controllable by opening and closing of one or more of said several outlets.

11. Impulse generator as claimed in claim 10, wherein said outlets have different diameters.

12. Impulse generator as claimed in claim 11, wherein said outlets are connected to one or more reservoirs (24) with one or more flow paths, wherein said reservoirs (24) in operation can be pressurized to different pressures, whereby a step-by-step and/or a continuous depressurization of the pressure relief chamber can be obtained by opening of said outlets.

13. Impulse generator as claimed in claim 10, wherein said outlets are connected to one or more reservoirs (24) with one or more flow paths, wherein said reservoirs (24) in operation can be pressurized to different pressures, whereby a step-by-step and/or a continuous depressurization of the pressure relief chamber can be obtained by opening of said outlets.

14. Impulse generator as claimed in claim 1, wherein the main chamber (4) has a circular cross-section.

15. Impulse generator as claimed in claim 1, wherein the main chamber (4), the prepressurizing chamber (12), and the pressure relief chamber (16) are adapted to receiving fluid volume from a fluid from the group: water, silicone oil, hydrolic oil, mineral oil, and non-combustible hydraulic fluid.

16. Method for generation of impulses in a rock breaking tool, the impulse generator (2) comprising a main chamber (4) for receiving a first pressurizeable fluid volume (6), and an impulse piston (8) received in the main chamber (4) which is arranged for transfer of pressure energy in the fluid volume (6) into impulses in the tool (10), and a prepressurizing chamber(12) situated on the side of the impulse piston opposite the main chamber for receiving a second pressurizeable fluid volume (14), wherein the impulse generator (2) further comprises a pressure relief chamber (16) situated on the side of the impulse piston opposite the main chamber for receiving a third pressurizeable fluid volume (18), the steps of said method comprising, pressurizing the prepressurizing chamber (12) for moving the impulse piston (8) in a direction towards the main chamber (4), pressurizing the pressure relief chamber (16), thereafter depressurizing the prepressurizing chamber (12) whereby the pressure in the main chamber (4) effects the impulse piston (8) so that the pressure in the pressure relief chamber (16) is further increased, and thereafter depressurizing the pressure relief chamber (16) whereby a pressure impulse is transferred into the tool (10).

17. Method as claimed in claim 16, further comprising the step of controlling the depressurization in said pressure relief chamber (16).

18. Method for generation of impulses in a rock breaking tool, the impulse generator (2) comprising a main chamber (4) for receiving a first pressurizeable fluid volume (6), and an impulse piston (8) received in the main chamber (4) which is arranged for transfer of pressure energy in the fluid volume (6) into impulses in the tool (10), and a prepressurizing chamber(12) situated on the side of the impulse piston opposite the main chamber for receiving a second pressurizeable fluid volume (14), wherein the impulse generator (2) further comprises a pressure relief chamber (16) situated on the side of the impulse piston opposite the main chamber for receiving a third pressurizeable fluid volume (18), wherein the area of the impulse piston towards the main chamber (4) is smaller than the sum of the areas of the impulse piston (8) towards the prepressurizing chamber (12) and the pressure relief chamber (16) but larger than the area of the impulse piston (8) towards the pressure relief chamber (16), the steps of said method comprising, pressurizing the main chamber (4), the prepressurizing chamber (12), and the pressure relief chamber (16) with the same pressure for moving the impulse piston (8) in a direction towards the main chamber (4), thereafter depressurizing the prepressurizing chamber (12) whereby the pressure in the main chamber (4) effects the impulse piston (8) so that the pressure in the pressure relief chamber (16) is further increased, and thereafter depressurizing the pressure relief chamber (16) whereby a pressure impulse is transferred into the tool (10).

19. Method as claimed in claim 18, further comprising the step of controlling the depressurization in said pressure relief chamber (16).

20. An impulse generator for a rock breaking tool, the impulse generator (2) comprising a main chamber (4) for receiving a first pressurizeable fluid volume (6), and an impulse piston (8) received in the main chamber (4) which is arranged for transfer of pressure energy in the fluid volume (6) into impulses in the tool (10), and a prepressurizing chamber (12) situated on the side of the impulse piston opposite the main chamber for receiving a second pressurizeable fluid volume (14), wherein the impulse generator (2) further comprises a pressure relief chamber (16) situated on the side of the impulse piston opposite the main chamber for receiving a third pressurizeable fluid volume (18), said impulse generator further comprising, means for pressurizing the prepressurizing chamber (12) for moving the impulse piston (8) in a direction towards the main chamber (4), means for pressurizing the pressure relief chamber (16), means for thereafter depressurizing the prepressurizing chamber (12) whereby the pressure in the main chamber (4) effects the impulse piston (8) so that the pressure in the pressure relief chamber (16) is further increased, and means for thereafter depressurizing the pressure relief chamber (16) whereby a pressure impulse is transferred into the tool (10).

21. An impulse generator for a rock breaking tool, the impulse generator (2) comprising a main chamber (4) for receiving a first pressurizeable fluid volume (6), and an impulse piston (8) received in the main chamber (4) which is arranged for transfer of pressure energy in the fluid volume (6) into impulses in the tool (10), and a prepressurizing chamber (12) situated on the side of the impulse piston opposite the main chamber for receiving a second pressurizeable fluid volume (14), wherein the impulse generator (2) further comprises a pressure relief chamber (16) situated on the side of the impulse piston opposite the main chamber for receiving a third pressurizeable fluid volume (18), wherein the area of the impulse piston towards the main chamber (4) is smaller than the sum of the areas of the impulse piston (8) towards the prepressurizing chamber (12) and the pressure relief chamber (16) but larger than the area of the impulse piston (8) towards the pressure relief chamber (16), said impulse generator further comprising, means for pressurizing the main chamber (4), the prepressurizing chamber (12), and the pressure relief chamber (16) with the same pressure for moving the impulse piston (8) in a direction towards the main chamber (4), means for thereafter depressurizing the prepressurizing chamber (12) whereby the pressure in the main chamber (4) effects the impulse piston (8) so that the pressure in the pressure relief chamber (16) is further increased, and means for thereafter depressurizing the pressure relief chamber (16) whereby a pressure impulse is transferred into the tool (10).

* * * * *